US006782826B1

(12) United States Patent
O'Dwyer

(10) Patent No.: US 6,782,826 B1
(45) Date of Patent: Aug. 31, 2004

(54) DECOY

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 10/130,542

(22) PCT Filed: Nov. 17, 2000

(86) PCT No.: PCT/AU00/01406

§ 371 (c)(1),
(2), (4) Date: Sep. 30, 2002

(87) PCT Pub. No.: WO01/36896

PCT Pub. Date: May 25, 2001

(30) Foreign Application Priority Data

Nov. 18, 1999 (AU) ..... PQ4132

(51) Int. Cl.[7] ..... F42B 12/70

(52) U.S. Cl. ..... 102/341; 102/336; 102/342; 102/402; 102/501; 102/505; 89/1.8; 89/1.815; 434/11

(58) Field of Search ..... 102/341, 342, 102/336, 402, 505, 293, 501, 217, 489; 434/11; 89/1.8, 1.813, 1.815, 1.816

(56) References Cited

U.S. PATENT DOCUMENTS

| | | | | | |
|---|---|---|---|---|---|
| 3,437,039 | A | * | 4/1969 | Hawthorne | 102/436 |
| 3,708,563 | A | * | 1/1973 | Sells | 264/46.5 |
| 3,712,224 | A | * | 1/1973 | Hanzel | 102/342 |
| 3,721,196 | A | * | 3/1973 | Willis et al. | 102/505 |
| 3,808,941 | A | * | 5/1974 | Biggs | 89/1.51 |
| 3,841,219 | A | * | 10/1974 | Schillreff | 102/342 |
| 4,012,985 | A | * | 3/1977 | Magnusson | 89/1.818 |
| 4,063,485 | A | * | 12/1977 | Carter et al. | 89/1.816 |
| 4,069,762 | A | * | 1/1978 | Maury | 102/341 |
| 4,135,455 | A | | 1/1979 | Wallace | 102/217 |
| 4,183,302 | A | * | 1/1980 | Schillreff | 102/377 |
| 4,222,306 | A | * | 9/1980 | Maury | 89/1.41 |
| 4,286,498 | A | * | 9/1981 | Block et al. | 86/1.1 |
| 4,333,402 | A | * | 6/1982 | Landstrom et al. | 102/505 |
| 4,342,556 | A | | 8/1982 | Hasse | 434/22 |
| 4,406,227 | A | * | 9/1983 | Beeker et al. | 102/505 |
| 4,621,579 | A | * | 11/1986 | Badura et al. | 102/334 |
| 4,625,972 | A | * | 12/1986 | Task et al. | 273/348 |
| 4,709,615 | A | | 12/1987 | Field | 89/1.56 |
| 4,829,905 | A | * | 5/1989 | Lew et al. | 102/489 |
| 5,061,930 | A | * | 10/1991 | Nathanson et al. | 342/13 |
| 5,397,236 | A | * | 3/1995 | Fegg et al. | 434/11 |
| 5,400,690 | A | * | 3/1995 | Meili et al. | 89/1.816 |
| 5,526,751 | A | * | 6/1996 | Spivey et al. | 102/341 |
| 5,661,254 | A | * | 8/1997 | Steuer et al. | 89/1.815 |
| 5,883,329 | A | * | 3/1999 | O'Dwyer | 102/217 |
| 5,895,882 | A | * | 4/1999 | Woodall, Jr. | 102/341 |
| 6,230,629 | B1 | * | 5/2001 | Doctor et al. | 102/337 |
| 6,431,076 | B1 | * | 8/2002 | O'Dwyer | 102/525 |
| 6,626,396 | B2 | * | 9/2003 | Secker | 244/3.16 |

FOREIGN PATENT DOCUMENTS

| | | | |
|---|---|---|---|
| AU | 43322/85 | | 12/1985 |
| AU | 43323/85 | | 12/1985 |
| EP | 0048204 | * | 3/1982 |
| EP | 0 124 183 | | 11/1984 |
| EP | 2 327 116 | | 1/1999 |
| FR | 2 294 420 | | 7/1976 |
| FR | 2 682 751 | A1 | 4/1993 |
| WO | WO 94/20809 | | 9/1994 |
| WO | WO 00/62004 | | 10/2000 |
| WO | WO 00/62005 | | 10/2000 |
| WO | WO01/36900 | * | 5/2001 |

* cited by examiner

*Primary Examiner*—Michael J. Carone
*Assistant Examiner*—John Richardson
(74) *Attorney, Agent, or Firm*—Finnegan, Henderson, Farabow, Garrett & Dunner, LLP

(57) ABSTRACT

A method of decoying an incoming missile from a target. The method comprises deploying an array of barrels each containing multiple projectiles, determining a position and orientation for a decoy image of the target in relation to the incoming missile, and firing multiple projectiles substantially simultaneously from respective barrels of the array to create the image. Each projectile contains image forming matter.

7 Claims, 3 Drawing Sheets

DECOY

BACKGROUND OF INVENTION

1. Field of the Invention

This invention relates to forming temporary airborne images. In particular, this invention relates to forming temporary airborne images that may act as decoys for homing missiles and the like.

2. Discussion of the Background Art

Large targets, such as war ships, are prone to damage by attack from airborne missiles provided with homing capabilities that may include thermal or image sensing devices for maintaining the missile on target to impact the target. War ships are generally provided with defensive weaponry for combating incoming missiles by targeting the incoming missile with multiple rounds of munitions such as by a phalanx system. However such missiles may prove difficult targets and even a successful encounter with an incoming missile may be very costly in terms of resources and operational personnel.

SUMMARY OF THE INVENTION

We have now found a method of forming a temporary airborne image that acts as a decoy for homing missiles, guided airborne weapons and the like.

DISCLOSURE OF THE INVENTION

Accordingly the present invention provides a method of decoying an incoming missile from a target by forming a temporary image, said method including the steps of arranging a plurality of projectiles in each bore of one or more barrel assemblies wherein each projectile includes a body and a trailing collar captively mounted to the projectile body for operatively sealing with a respective bore, and wherein said projectiles include image forming matter for mimicking a homing characteristic of the target, firing a predetermined number of the plurality of projectiles from selected barrel assemblies, and deploying the image forming matter to form a temporary image and decoy the incoming missile from the target.

This invention may utilise barrel assemblies capable of firing a controlled rapid fire sequence of mortar like projectiles and being of the general type described and/or illustrated in earlier International Patent Applications by the present inventor, such as PCT/AU94/00124, PCT/AU00/00296 and PCT/AU00/00297. In at least some of these earlier applications, including the earliest filed International Application No. PCT/AU94/00124 there are described arrangements for grouping barrels each containing a plurality of projectiles so that a large number of projectiles can be fired in rapid-fire succession. In such arrangements barrels may be formed from a cylindrical shell having a plurality of projectiles axially disposed within the shell for operative sealing engagement with the bore of the shell and discrete propellant charges for propelling respective projectiles.

Suitably the barrel assemblies may be of the low pressure type which fire grenade-like projectiles although high muzzle pressure barrel assemblies may be used. Respective barrel assemblies may be loaded with different projectiles and the barrel assemblies may have different size bores for accommodating different size projectiles.

Suitably each projectile includes a trailing collar captively mounted to the projectile body and when stored in the barrel, extends rearwardly to wedge against the nose portion of a trailing projectile body. Suitably the wedging action is provided by a shallow wedge whereby, in use, the trailing end of the collar is expanded into operative sealing engagement with the barrel.

The trailing collar may be mounted for limited axial movement relative to the projectile body and the leading end of the collar formed with an annular sealing face engageable with a complementary face formed on the projectile body whereby rearward movement of the projectile body resulting from the reaction of the propellant gases thereon forces its complementary face into sealing engagement with the annular sealing face at the leading end of the collar.

The complementary face and the annular sealing face may extend substantially radially and be formed with complementary sealing features thereon. However it is preferred that these faces are complementary part-conical sealing faces which wedge into tight sealing engagement with one another. The leading end part may also be expandable into operative sealing engagement with the barrel. Suitably however the wedging between the part-conical faces are relatively steep faces whereby the leading end of the collar is not expanded into operative sealing engagement with the barrel by the wedging action.

Preferably, each projectile is associated with a high pressure propellant chamber which exhausts to respective low pressure propulsion chambers formed between the adjacent projectiles for efficient low muzzle velocity operation. The high pressure propellant chambers may be formed integrally with the projectile body or the trailing collar or be provided at the exterior of the barrel to communicate therewith through ports provided through the barrel wall.

The image forming matter may include, for example, explosive matter, incendiary matter, incandescent or luminous matter or other matter to provide a highly visible temporary image, radar image and/or a thermal image for mimicking a homing characteristic of the target. For example, in order to decoy a thermal image homing missile a thermal image may be provided to deceive the incoming missile to detonate on the thermal image of the target leaving the target substantially intact.

Alternatively, the image forming matter may include smoke, gas, particles or sheets or strips, such as in the nature of chaff or similar radar reflective matter, or other material capable of being dispersed to form an image. The image forming matter may also include means for slowing its descent from its dispersed position, such as a parachute and the like.

The projectiles are arranged in the barrel assemblies such that once fired and the image forming matter deployed, the desired temporary airborne image is formed. Projectiles containing different image forming matter may be sequentially loaded into each barrel assembly.

The projectiles may be electronically fired at an infinitely variable frequency up to the maximum rate of fire. For firing from a barrel assembly according to an aspect of this invention and arranged for low pressure, low muzzle velocity, the rate of firing is limited by the time taken for each projectile to leave the barrel and by the time necessary for the gas pressure in the barrel to drop sufficiently to enable the firing of the next projectile.

The predetermined number of the plurality of projectiles may be fired from selected barrel assemblies at a rate selected to obtain the desired temporary airborne image. The firing of the projectiles may preferably be controlled by a microprocessor to permit the accurate firing of the projectiles at the selected rate.

The image forming matter may be deployed, for example, by explosive means, by stored energy or by separation of separable parts of the projectile to expose the image forming matter or by any other suitable dispersing means.

A timing mechanism to control the deployment may be of any suitable type and may be clock based or based on a flight characteristics of the projectile such as the number of spins of a projectile fired from a rifled barrel or it may be based on the ambient atmospheric conditions at the selected display position. Alternatively, the timing mechanism may selectively control the timing of deployment of parachutes associated with the image forming matter.

The image may be formed as an upright image or a horizontal image and may include either or both image forming matter which leaves a visible trail during descent and image forming matter which does not leave a visible trail during descent. The former may be used to provide a coloured background or a stripe or the like while the latter may provide feature within the image such as a bright star-like image.

The projectiles may be configured to disperse the image forming matter at a set time from firing and the firing may be controlled for trajectory or barrel exit velocity so that upon dispersal of the image forming matter the desired displayed is achieved. Alternatively a barrel assembly may contain respective projectiles adapted to produce different image effects and the desired image may be controlled by selectively firing the projectiles to assemble an in-air compilation of different image effects to achieve the desired image.

For the purpose of the decoy images the projectiles may be fired to provide a general zone having either the necessary extent or thermal or visual characteristics so as to trigger a missile directed at the vessel or installation being defended. Alternatively, the projectiles may be fired to produce a shape which mimics the shape of the vessel or installation being defended, so as to appear to the missile to be the vessel or installation being defended.

A bank of barrel assemblies may be utilised containing respective image forming matter which may be selectively fired and, if desired at a desired trajectory or timing, the barrel assemblies being controlled remotely such as from a computer keyboard and screen which may show a preview of the image to be formed and enabling an operator to "print" a desired or random airborne pattern. The image may be a two or three dimensional image as desired. Different banks of barrel assemblies may be utilised and/or placed so as to form a respective unique portion of the image being formed.

A direction control means may be provided in a bank of barrel assemblies and may permit uniform pivoting of the barrel assemblies so that the inclination of the axes of the barrel assemblies relative to the axis of a pod containing the bank of barrel assemblies may be selectively varied to enable a target position relative to the pod to be varied. The direction control means may permit individual pivoting of each barrel assembly so that the inclination of each barrel axis relative to a pod. axis may be individually varied to enable a target position or individual target positions relative to the pod to be varied. Such individual control may be associated with individual firing control of each barrel assembly if desired.

The direction control means may alternatively permit a controlled splaying of all barrel assemblies so that the area covered at the target zone may be selectively varied. Alternatively the direction control means may permit all or some of the above variations to be achieved individually or collectively as required.

The pod housing may be of any suitably configuration and may taper towards its base to enable barrel assemblies to be supported in a splayed attitude. The support means may be fold out legs which may be adjustable if desired. In one form the pod has a rectangular pod housing for economy or ease of storage and/or transport and the base thereof constitutes the support means.

A pod of barrel assemblies may be fired from a marine platform. The pod may also be fired from an aircraft, or from a number of aircraft flying in formation and if desired, with the firing coordinated between the aircraft by a suitable electronic link. The image could be formed parallel to the firing path, such as by projecting projectiles different distances so as to span the length of the image to be formed. Alternatively, the image could be created at right angles to the firing path by splaying projectiles to deploy across the desired span of the desired image. Thus even though there may not be a clear line of sight between a deck mounted pod containing the barrel assemblies utilised to create the image and an incoming missile, the image can be created at right angles to the incoming path of the missile.

BRIEF DETAILS OF THE DRAWINGS

In order that this invention may be more readily understood and put into practical effect, reference will now be made to the accompanying drawings which illustrate a typical embodiment of the invention and wherein.

DESCRIPTION OF EMBODIMENTS OF THE INVENTION

Figure 1:
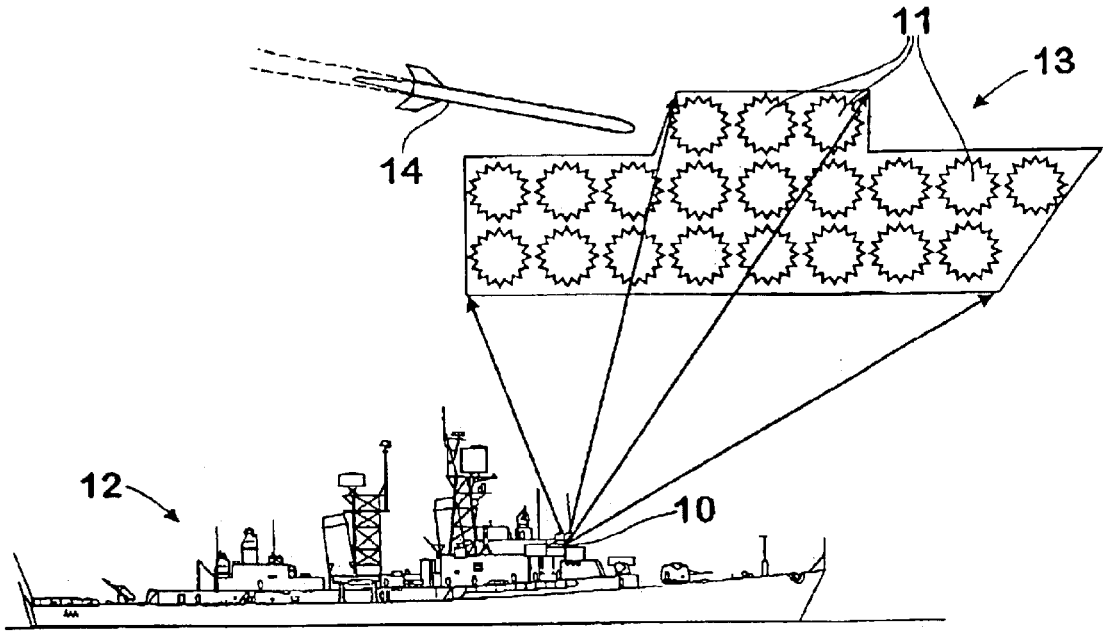
FIG. 1 is a diagrammatic view of a temporary airborne image fired from a ship for protecting the ship against a homing missile.

Referring to FIG. 1 of the drawings, it will be seen that a barrel assembly 10 of the type described loaded with mortar-like projectiles which explode mid air 11 at a set distance and trajectory from the barrel assembly 10 or barrel assemblies supported on the vessel 12 will provide a thermal image 13 of similar size and shape to the vessel 12. This is intended to provide an airborne thermal image 13 at an elevated position at a safe distance from the vessel 12 which will attract an incoming missile 14 and either cause it to explode upon reaching the image 13 or at least to cause the missile 14 to divert sufficiently from its flight path to the vessel 12 so that it will miss the vessel 12.

The image 13 is suitably formed to one side of the vessel 12 and at a position which will minimise the chance of the missile guidance system returning the missile 14 to an on-target flight path. Preferably. the image 13 is formed between the missile 14 and the vessel 12 being protected and slightly to one side and at a relatively low elevation so that the decoyed or misguided missile 14 will be descending toward the decoy image 13 and impact the water away from the vessel 12. This arrangement also partly shields the vessel 12 to be protected and thus eliminates a target choice for the incoming missile 14.

Figure 2:
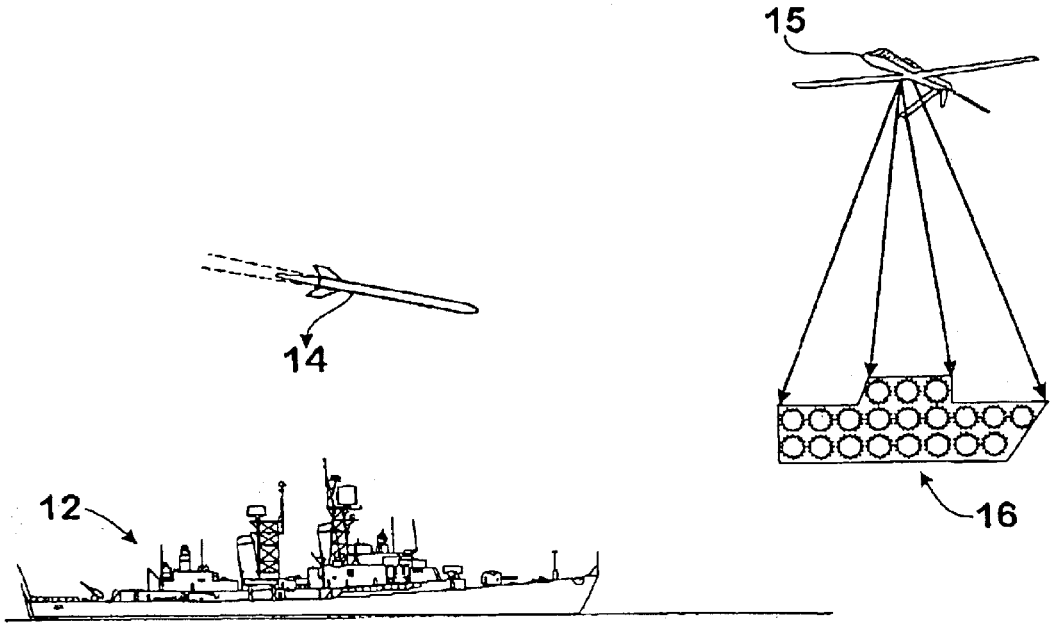
FIG. 2 is a diagrammatic view of a temporary airborne images fired from an aircraft for protecting a ship against a homing missile.

In the embodiment illustrated in FIG. 2, the barrel assemblies from which the projectiles are fired are supported on an aircraft 15, which may be an unmanned remote controlled aircraft, if desired. As such an aircraft 15 has sufficient mobility to defend a variety of targets, it is preferred that the barrel assemblies be controlled for selective discharge of the projectiles in respect of sequence and trajectory, whereby a variety of shapes or images 16 may be selectively formed to suit the target being attacked.

Thus a single aircraft 15 or a fleet of circling aircraft flying in picket formation about the fleet to be protected may provide the fleet with cover against attack by incoming missiles 14, even if those missiles 14 are target specific, as the images 16 may be instantly specified to suit the target to be defended. This can be achieved without the need to preconfigure the groups of projectiles for each specific vessel 12 or installation to be defended, thereby providing a significant benefit in versatility.

Figure 3:
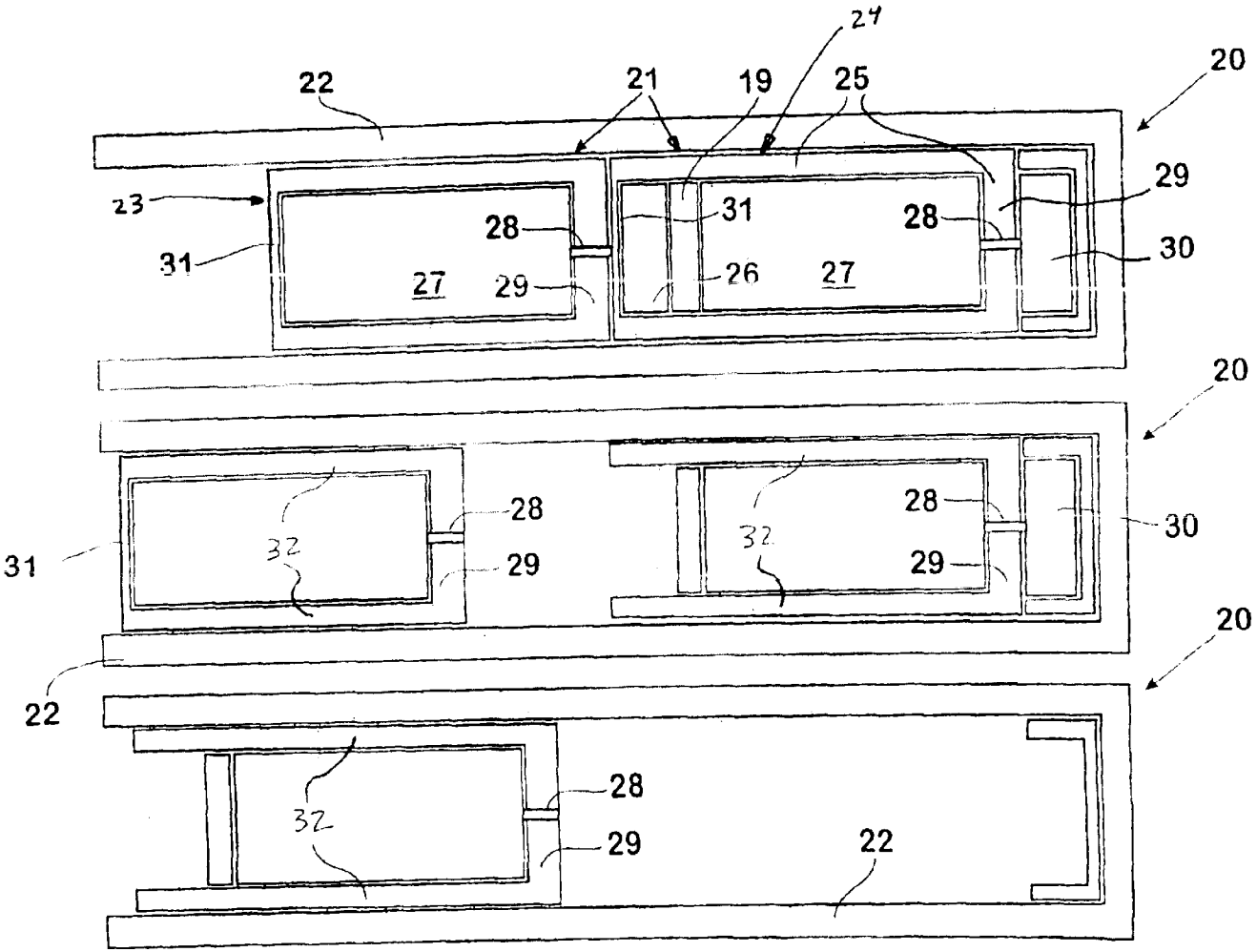
FIG. 3 is a diagrammatic side view of a barrel assembly not being of the type described but suitable for firing projectiles for forming a temporary airborne image.

Referring to FIG. 3, it will be seen that an alternate barrel assembly 20 may include a plurality of projectiles 21 arranged in an axial abutting relationship in a barrel 22, the projectiles including a leading projectile 23 and following projectiles 24, only one of which following projectile 24 is illustrated. Each following projectile 24 includes an outer case 25 of a suitable plastic or other suitable material and supporting therein a leading propellant charge 26 for propelling the projectile 21 preceding it in the barrel 22, a separator disc 19 separating the leading propellant charge 26 from the remainder of the projectile interior which supports a pyrotechnic charge 27, which burns and/or explodes in the atmosphere to provide a respective portion of the airborne image to be created.

A controlled rate burn link 28 extends through the back wall 29 of the case 25. This receives its ignition from the burning propellant 26 as it exits the barrel 22 and detonates the pyrotechnic material 27 when it burns fully through the back wall 29. The base of the barrel 22 supports a separate propellant charge 30 for propelling the last of the following projectiles 24 from the barrel 22.

The initiation means for detonating the propellant charges 26 and 30 may be via an external barrel mounted primer or be achieved electronically through spaced annular contacts extending about the case 25 and contacting respective sets of contacts in the barrel 22. As illustrated, the front wall 31 of the case 25 is relatively thin so that it will be easily ruptured by detonation of the propellant 26 for propelling the preceding projectile 21 from the barrel 22. In this action, the separator 19 will prevent back burning into the pyrotechnic charge 27 and expansion of the cylindrical side wall 32 into flight engagement with the barrel 22, thus preventing bypass about the projectile 21 containing the propellant 26 and 30 being detonated to a trailing projectile 24.

Figure 4:
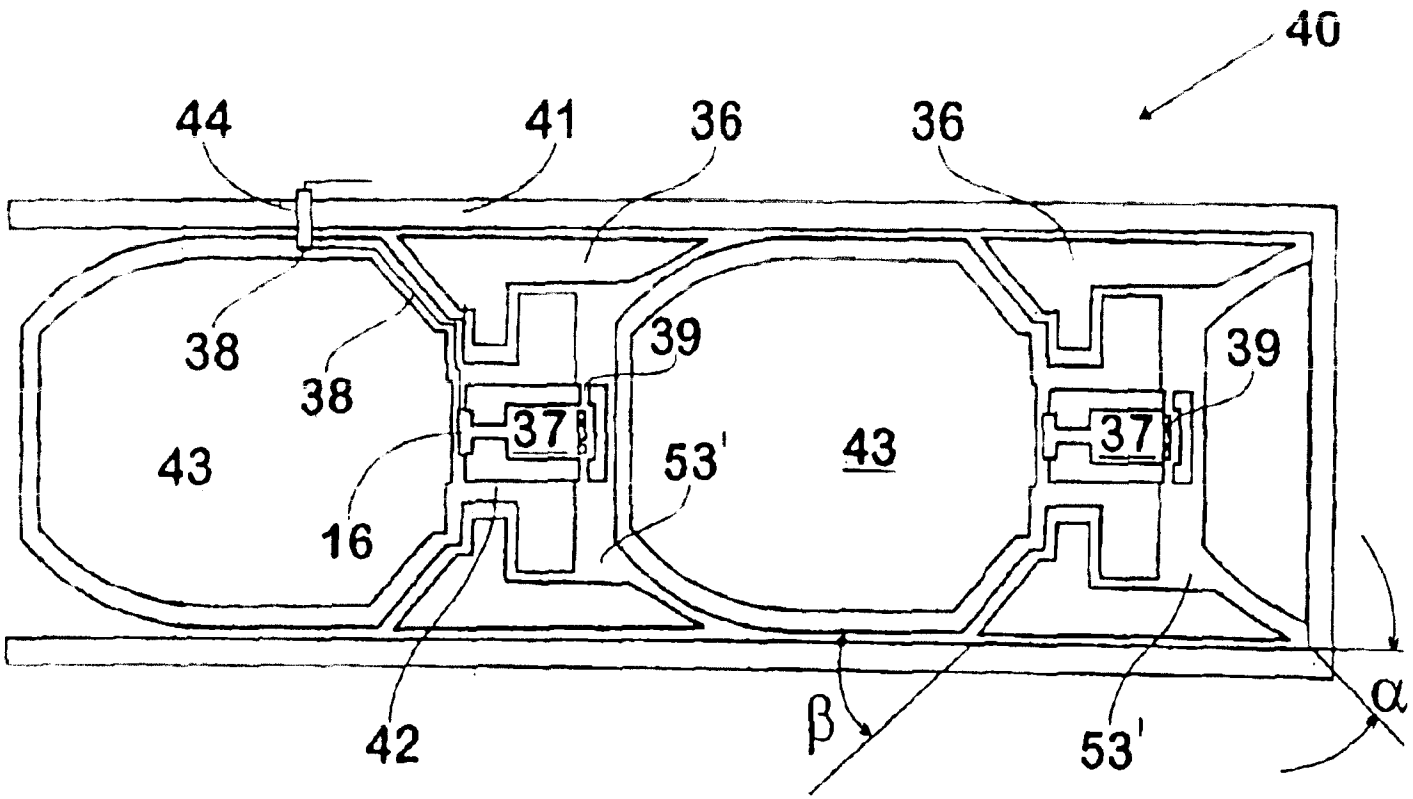
FIG. 4 diagrammatically illustrates a typical barrel assembly for use in this invention.

The barrel assembly 40 illustrated in FIG. 4 includes wedge sealing angles $\alpha$ and $\beta$ between the trailing sleeve 36 and the projectile body 42. In this embodiment, which is more suited to low pressure low muzzle velocity applications, the opposed ends of the trailing sleeve 36 formed by the sealing angles $\alpha$ and $\beta$ of between 30° and 55° are sufficiently blunt as to resist outward splaying into sealing engagement with the barrel 41 under the influence of propellant pressures. Typically, these would be in the order of 3,000 to 5,000 psi with muzzle velocities of about 70 m/sec and 250 m/sec, respectively.

It will be seen that the bulbous nose part 43 of the projectile body 42 is hollow for carrying image forming matter. The propellant 37 in the high pressure chamber is selectively ignited to expel high pressure gases through the trailing ports 39 into the low pressure chamber 53' by a detonator or primer 16 triggered through an electrical circuit which uses the projectile column as one part of the circuit. The barrel 41 is made of insulating material or so lined and with the circuit completed by an imbedded insulated wire 38 leading from the primer 16 to a contact 38 on the projectile surface which is aligned when loaded, with a complementary contact 44 supported in the barrel 41.

Alignment of the contacts can be achieved in a barrel and projectile located by rifling grooves during the loading process. In a non-rifled design, the use of a annular contact in the barrel wall can achieve a similar result.

It will of course be realised that the foregoing description has been given only by way of illustrative example of this invention and that all such and other modifications and variations thereto as would be apparent to persons skilled in the art are deemed to fall within the broad scope and ambit of this invention as is herein set forth in the following claims.

I claim:

1. A method of decoying an incoming missile from a target, comprising:

deploying an array of barrels each containing multiple projectiles, each projectile containing image forming matter, determining a position and orientation for a decoy image of the target in relation to the incoming missile, and firing multiple projectiles substantially simultaneously from respective barrels of the array to create the image.

2. A method according to claim 1 further comprising renewing the image by firing further projectiles simultaneously from the array.

3. A method according to claim 1 further comprising selecting the decoy image from a range of possible images according to the target.

4. A method according to claim 1 further comprising aiming each barrel in the array independently of the other barrels.

5. A method according to claim 1, wherein the image is a visual, thermal or radar image, in two or three dimensions.

6. Apparatus for decoying an incoming missile from a target, including:

an array of barrels each having multiple projectiles containing image forming matter, and a control system that determines a position and orientation for a decoy image of the target in relation to the incoming missile, wherein the control system triggers firing of multiple projectiles substantially simultaneously from the array to create the decoy image.

7. Apparatus according to claim 6 wherein each projectile contains matter that forms a visual, thermal or radar component of the decoy image.

* * * * *